United States Patent [19]

Capek et al.

[11] Patent Number: 4,745,330

[45] Date of Patent: May 17, 1988

[54] FACEPLATE FRONT ASSEMBLY WITH IMPROVED CERAMIC TENSION MASK SUPPORT STRUCTURE

[75] Inventors: Raymond G. Capek, Elmhurst; Jennifer M. Knowlton, Wilmette, both of Ill.

[73] Assignee: Zenith Electronics Corporation, Glenview, Ill.

[21] Appl. No.: 6,391

[22] Filed: Jan. 23, 1987

[51] Int. Cl.[4] ..... H01J 29/07; H01J 29/82

[52] U.S. Cl. ..... 313/407; 313/408

[58] Field of Search ..... 313/402, 407, 408

[56] References Cited

U.S. PATENT DOCUMENTS

| | | | |
|---|---|---|---|
| 4,473,772 | 9/1984 | de Keijer | 313/402 |
| 4,595,857 | 6/1986 | Rowe et al. | 313/407 |
| 4,614,892 | 9/1986 | Palac | 313/402 |

FOREIGN PATENT DOCUMENTS 56-141148 2/1980 Japan .

OTHER PUBLICATIONS

Robinder et al., "A High-Brightness Shadow-Mask Color CRT for Cockpit Displays", 1983 symposium, Society for Information Display.

Fyler et al., "The CBS Colortron: A Color Picture Tube of Advanced Design", Proceedings of the Institute of Radio Engineers (IRE), Jan. 1954.

TEKT8100, "Avionics Color Cathode Ray Tube", Tektronix, 1983.

*Primary Examiner*—David K. Moore
*Assistant Examiner*—K. Wieder

[57] ABSTRACT

A faceplate assembly for a color cathode ray tube includes a glass faceplate having on its inner surface a centrally disposed phosphor screen. A foil shadow mask is mounted in tension on a mask support structure located on opposed sides of the screen and secured to the inner surface. The mask support structure has a metal cap for receiving and mounting the shadow mask in tension. The mask support structure according to the invention includes at least two adhered layers of ceramic having different coefficients of thermal expansion effective to match the different coefficients of thermal expansion of the metal of said cap and the glass of said faceplate.

10 Claims, 3 Drawing Sheets

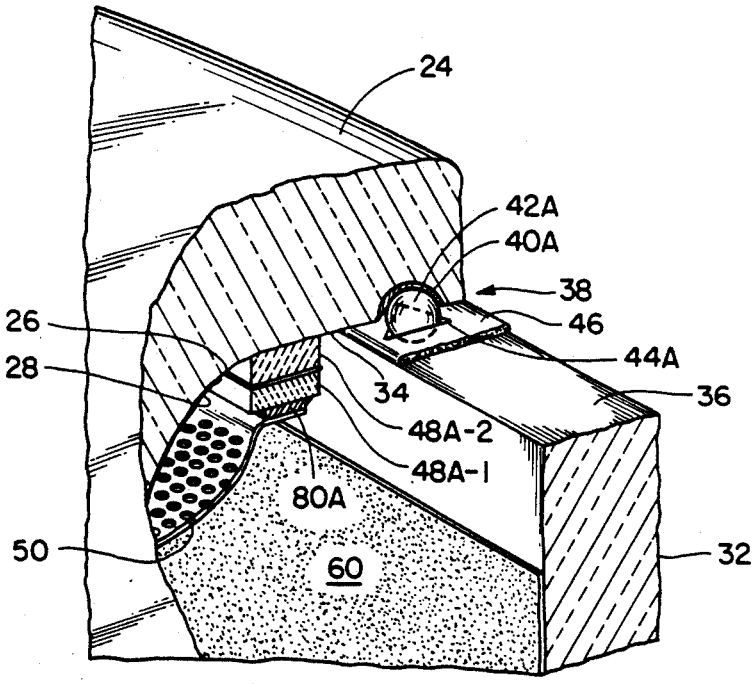
Fig. 3
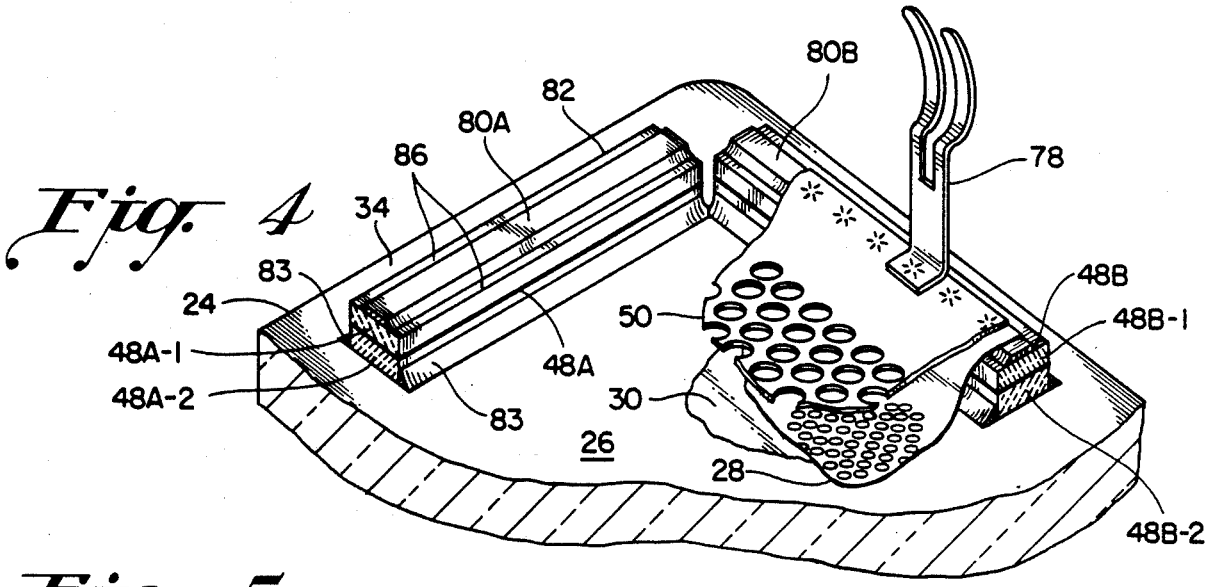
Fig. 4
Fig. 5
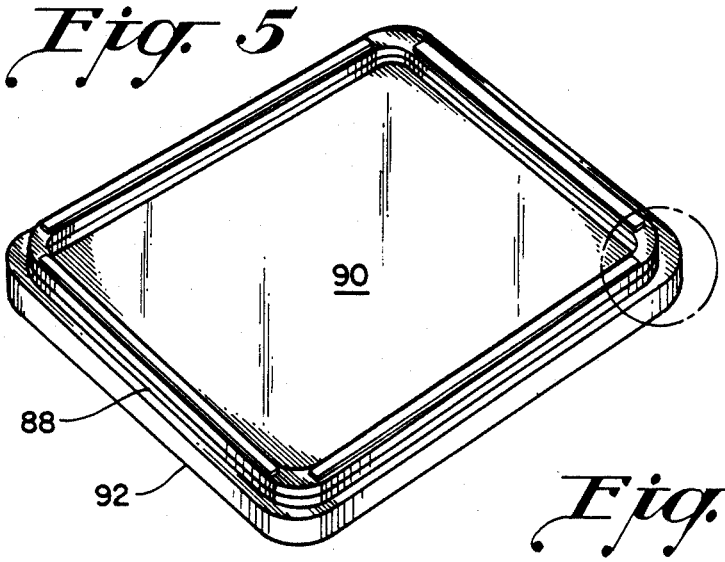
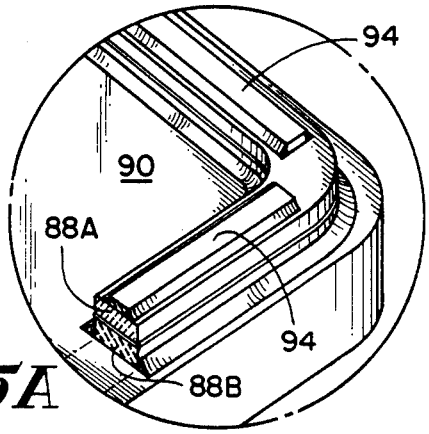
Fig. 5A

FACEPLATE FRONT ASSEMBLY WITH IMPROVED CERAMIC TENSION MASK SUPPORT STRUCTURE

CROSS-REFERENCE TO RELATED APPLICATIONS AND PATENTS

This application is related to but in no way dependent upon copending applications Ser. No. 832,493 filed Feb. 21, 1986; Ser. No. 832,556 filed Feb. 21, 1986 now U.S. Pat. No. 4,695,761; Ser. No. 831,696 filed Feb. 21, 1986; Ser. No. 831,699 filed Feb. 21, 1986 now U.S. Pat. No. 4,686,416, Ser. No. 866,030 filed Apr. 21, 1986; and Ser. No. 925,424 filed Oct. 31, 1986, all of common ownership herewith.

SPECIFICATION

This specification includes an account of the background of the invention, a description of the best mode presently contemplated for carrying out the invention, and appended claims.

BACKGROUND OF THE INVENTION

1. Field of the Invention

This invention relates to color cathode ray picture tubes, and is addressed specifically to an improved front assembly for color tubes having shadow masks of the tension foil type in association with a substantially flat faceplate. The invention is useful in color tubes of various types, including those used in home entertainment television receivers, and in medium-resolution and high-resolution tubes intended for color monitors.

The use of the foil-type flat tension mask and flat faceplate provides many benefits in comparison to the conventional domed shadow mask and correlatively curved faceplate. Chief among these is a greater power-handling capability which makes possible as much as a three-fold increase in brightness. The conventional curved shadow mask, which is not under tension, tends to "dome" in picture areas of high brightness where the intensity of the electron beam bombardment is greatest. Color impurities result as the mask moves closer to the faceplate and as the beam-passing apertures move out of registration with their associated phosphor elements on the faceplate. The tension mask when heated distorts in a manner quite different from the conventional mask. If the entire mask is heated uniformly, there is no doming and no distortion until tension is completely lost; just before that point, wrinkling may occur in the corners. If only portions of the mask are heated, those portions expand, and the unheated portions contract, resulting in displacements within the plane of the mask; i.e., the mask remains flat.

The tension foil shadow mask is a part of the cathod ray tube front assembly, and is located in close adjacency to the faceplate. The front assembly comprises the faceplate with its screen consisting of deposits of light-emitting phosphors, a shadow mask, and support means for the mask. As used herein, the term "shadow mask" means an apertured metallic foil which may, by way of example, be about 0.001 inch thick, or less. The mask must be supported in high tension a predetermined distance from the inner surface of the cathode ray tube faceplate; this distance is known as the "Q-distance." As is well known in the art, the shadow mask acts as a color-selection electrode, or parallax barrier, which ensures that each of the three beams lands only on its assigned phosphor deposits.

The requirements for a support means for a foil shadow masks mask are stringent. As has been noted, the foil shadow mask is normally mounted under high tension. The support means must be of high strength so the mask is held immovable; an inward movement of the mask of as little as 0.0002 inch can cause the loss of guard band. Also, it is desirable that the shadow mask support means be of such configuration and material composition as to be compatible with the means to which it is attached. As an example, if the support means is attached to glass, such as the glass of the inner surface of the faceplate, the support means must have a coefficient of thermal expansion compatible with the glass, and by its composition, be bondable to glass. Also, the support means should be of such composition and structure that the mask can be secured to it by production-worthy techniques such as electrical resistance welding or laser welding. Further, it is essential that the support means provide a suitable surface for mounting and securing the mask. The material of which the surface is composed should be adaptable to machining or other forms of shaping so that it can be contoured into near-perfect flatness so that no voids between the metal of the mask and the support structure can exist to prevent the positive, all-over contact required for proper mask securement.

2. Prior Art

An avionics color cathode ray tube having ceramic components is described in a journal article by Robinder et al of Tektronix, Inc. A shadow mask is mounted in a ceramic ring/faceplate assembly, with the mask suspended by four springs oriented in the z-axis. Ceramic is also used to form a two-piece, x-ray-attenuating body. A flat faceplate is utilized, together with a glass neck flare. (From "A High-Brightness Shadow-Mask Color CRT for Cockpit Displays," Robinder et al. Digest of a paper presented at the 1983 symposium, Society for Information Display.)

A color picture tube having a conventional curved faceplate and correlatively curved, untensed shadow mask is disclosed in Japanese Patent No. 56-141148 to Mitsuru Matshusita. The purpose according to a quotation from the abstract is "... To rationalize construction and assembly of a tube, by both constituting its envelope from a panel, ceramic shadow mask mounting frame and funnel and integrally forming a surplus electron beam shielding plate to the shadow mask mounting frame."

3. Other Prior Art

A journal article: "The CBS Colortron: A Color Picture Tube of Advanced Design." Fyler et al. Proceedings of the Institute of Radio Engineers (IRE), Jan. 1954.

OBJECTS OF THE INVENTION

It is an object of the invention to provide an improved faceplate assembly for a color cathode ray tube having a tensed foil shadow mask and a substantially flat faceplate.

It is another object of the invention to provide a improved support structure for mounting a tensed foil shadow mask on a substantially flat faceplate.

It is yet another object of the invention to provide an improved faceplate assembly having means for more securely mounting a tensed foil shadow mask.

It is a further object of this invention to provide a support structure for a tensed foil shadow mask that provides economies in materials and manufacture.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

FIG. 3 is a cutaway view in perspective of a section of the tube front assembly of FIG. 1, showing in greater detail the location and orientation of a part of the FIG. 1 embodiment of the shadow mask support structure following its installation in a cathode ray tube;

FIG. 4 is a perspective view of a corner section of the embodiment of the shadow mask support structure depicted in FIGS. 1–3, with a shadow mask indicated as being secured thereto;

FIG. 5 is a perspective view of a unitary shadow mask support structure according to the invention;

FIG. 5A is an enlarged view of one corner of the structure depicted in FIG. 5, showing additional details of the structure;

DESCRIPTION OF THE PREFERRED EMBODIMENT

Figure 1:
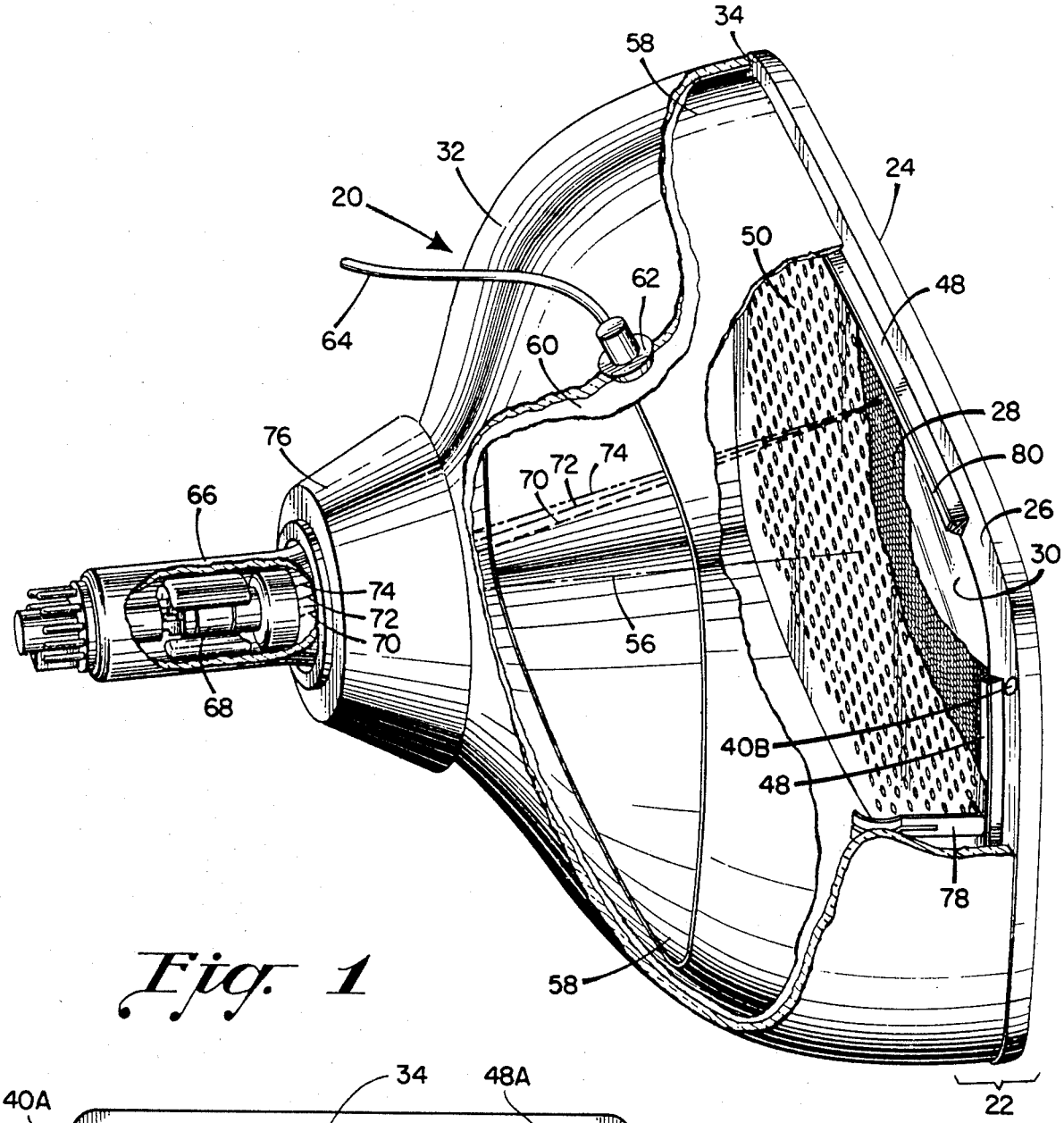
FIG. 1 is a side view in perspective of a color cathode ray tube having an improved shadow mask support structure according to the invention, with cut-away sections that indicate the location and relation of the structure to other major tube components.

A cathode ray tube having an improved structure according to the invention for supporting a tensed foil shadow mask is depicted in FIG. 1. The tube and its component parts are identified in FIGS. 1–3 and described in the following paragraphs in this sequence: reference numer, a reference name, and a brief description of structure, interconnections, relationship, functions, operation, and/or result, as appropriate. It is to be noted that the drawings are not to scale.

20 color cathode ray tube
22 faceplate assembly
24 faceplate
26 inner surface of faceplate
28 centrally disposed phosphor screen
30 film of aluminum
32 funnel
34 peripheral sealing area of faceplate 24, adapted to mate with the peripheral sealing area of funnel 32
36 peripheral sealing area of funnel 32, adapted to mate with sealing area 34 of faceplate 24
38 indexing means for registering faceplate 24 with funnel 32, and having these components;
40A, 40B, 40C pyramidal cavities in faceplate sealing area 34
42A, 42B 42C ball means
44A, 44B, 44C cavities in funnel sealing area 36
46 layer of frit for cementing faceplate 24 and funnel 32 together
48 support structure according to the invention for receiving and securing a tensed foil shadow mask; the support structure is depicted in this embodiment of the invention as comprising four rails 48A–D.
50 a metal foil shadow mask; after being tensed, the mask is mounted on support structure 48 and secured thereto
52 shadow mask apertures, indicated greatly enlarged in the inset
56 anterior-posterior axis of tube
58 internal magnetic shield—"IMS"
60 internal conductive coating on funnel
62 anode button
64 high-voltage conductor
66 neck of tube
68 in-line electron gun providing three discrete in-line electron beams for exciting the triads of phosphors deposited on screen 28
70, 72, 74 electron beams for activating respective red-light-emitting, green-light emitting, and blue-light-emitting phosphor deposits on screen 28
76 yoke which provides for the traverse of beams 70, 72 and 74 across screen 28
78 contact spring which provides an electrical path between the funnel coating 60 and the mask support structure 48

Figure 2:
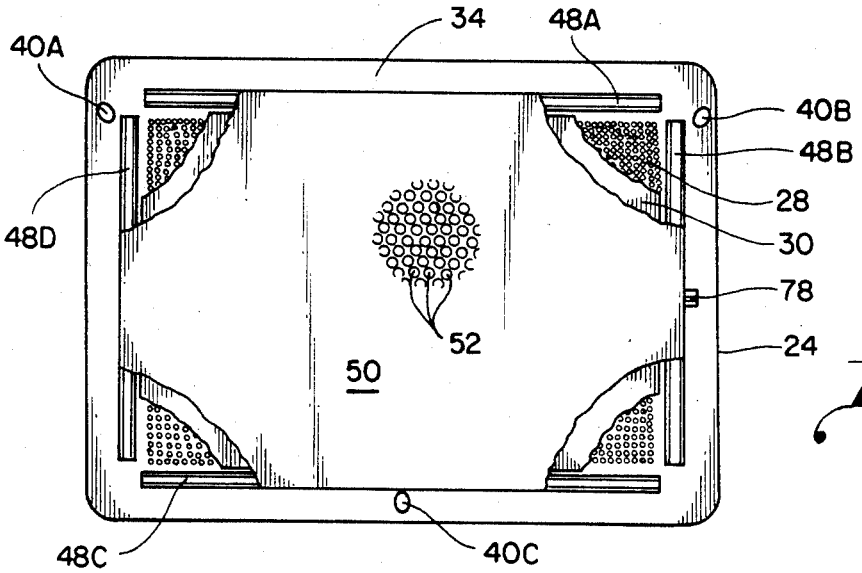
FIG. 2 is a plan view of the front assembly of the tube shown by FIG. 1, with pairs cut away to show the relationship of the embodiment of the mask support structure shown by FIG. 1 with the faceplate and the shadow mask; an inset depicts mask apertures greatly enlarged.

With reference to FIG. 4, there is depicted in greater detail a preferred embodiment of a shadow mask support structure 48 according to the invention comprising the support structure 48 depicted in FIGS. 1–3, and indicated symbolically as being composed of a ceramic material. The support structure according to this embodiment of the invention is indicated in FIG. 2 as comprising four discrete rails 48A–D located on opposed sides of screen 28 and secured to the inner surface 26 of faceplate 24; two of the rails are depicted in FIG. 4, rail 48A and 48B. Rails 48A and 48B are each depicted as having a metal cap 80A and 80B, respectively, thereon for receiving and mounting foil shadow mask 50 in tension. The ceramic rails according to the invention have at least two adhered layers of ceramic, shown as being two layers in this embodiment of the invention in each of the rails 48A and 48B; in rail 48A, there is indicated layers 48A-1 and 48A-2, and in rail 48B, there is indicated layers 48B-1 and 48B-2. The two adhered layers of ceramic have, according to the invention, different coefficients of thermal expansion effective to match the different coefficients of thermal expansion of the respective metal caps 80A and 80B, and the glass of the inner surface of faceplate 24. With reference rail 48A, the "first" layer of ceramic; that is, layer 48A-1 of ceramic nearest the cap and adhered thereto, has a coefficient of thermal expansion compatible with the coefficient of thermal expansion of the metal of the cap. The "second" layer of ceramic; that is layer 48A-2 nearest the faceplate and adhered thereto has a coefficient of thermal expansion compatible with the coefficient of thermal expansion of the glass of the faceplate. The layering of the support structure according to the invention is effective to match the different coefficients of thermal expansion and alleviate the stresses produced due to the different expansion coefficients of the metal of the cap and the glass of the faceplate. With regard to compatibility of the coefficient of thermal expansion, the coefficient of thermal expansion of the first layer is approximately equal to the metal of the cap to yield a minimum stress condition, and the coefficient of thermal expansion of the second layer is preferably higher than that of the glass to yield a minimum stress condition. By way of example, the coefficient of thermal expansion of the first layer is about $107\times10^{-7}$ in/in/degree C., and the coefficient of thermal expansion of the second layer is about $103\times10^{-7}$ in/in/degree C.

The caps preferably comprise a weldable material for securing shadow mask 50 by weldments, as indicated by the weldment symbols. The metal cap may be fastened to the surface 82 of the ceramic material by means of a suitable cement, the nature of which will be described infra.

Another embodiment of the invention is depicted in FIG. 5 in which a shadow mask support structure 88 is indicated as being a generally rectangular, unitary structure composed of ceramic secured to the inner surface 90 of a faceplate 92 on opposed sides of the screen in much the same manner as the support structure depicted in FIG. 4. The inset, FIG. 5A, depicts a corner section in greater detail, showing a metal cap 94, depicted as being discontinuous in the corner section, for receiving and mounting a shadow mask (not shown) in tension. The unitary mask support structure includes according to the invention two adhered layers of ceramic: layer 88A and layer 88B; the layers have different coefficients of thermal expansion effective to match the coefficients of thermal expansion of the metal caps 94 and the glass of the faceplate 90.

Tests have shown that the coefficient of thermal expansion of the first layer 88A is approximately equal to the coefficient of thermal expansion of the metal of the cap 94 to yield a minimum stress condition, while the coefficient of thermal expansion of the second layer 88B may be made higher than that of the glass of the faceplate 90 to yield a minimum stress condition. By way of example, and according to the invention, the coefficient of thermal expansion of the first layer 88A is about $107\times10^{-7}$ in/in/degree C., and the coefficient of thermal expansion of the second layer 88B is about $103\times10^{-7}$ in/in/degree C.

Figure 6:
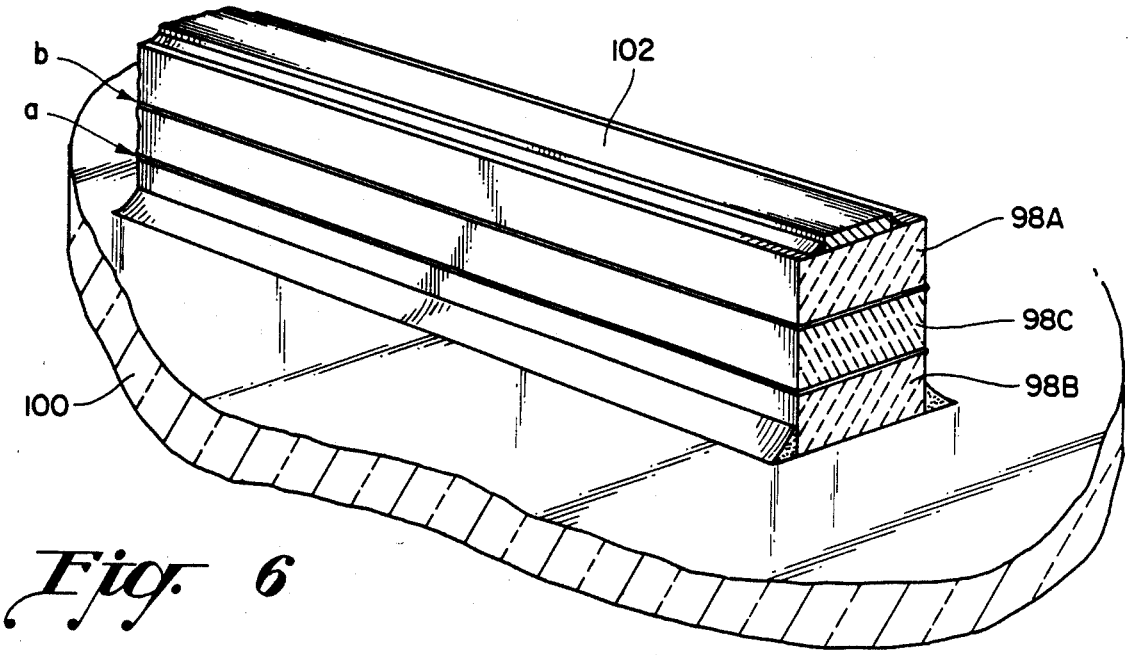
FIG. 6 is a view in perspective of a section of another embodiment of a shadow mask support structure according to the invention.

With reference now to FIG. 6, there is depicted a layered ceramic support structure according to the invention comprising three layers of ceramic of different coefficients of thermal expansion adhered together and effective to match the different coefficients of expansion of the metal cap and the glass of the faceplate. The structure is in effect a "sandwich" consisting of a first layer 98A of ceramic adhered to a metal cap 102 and having a coefficient of thermal expansion compatible with the coefficient of thermal expansion of the metal of cap 102. A second layer 98B of ceramic is indicated as being adhered to a faceplate 100; it has a coefficient of thermal expansion compatible with the coefficient of thermal expansion of the glass of faceplate 100. First layer 98A and second layer 98B are indicated as being spaced by a separating ceramic layer 98C which, according to the invention, has a coefficient of thermal expansion intermediate to the coefficients of thermal expansion of first layer 98A and second layer 98B. The layers and their different coefficients of thermal expansion are effective to absorb the stresses produced due to the different expansion coefficients of the glass of faceplate 100 and the metal cap 102. The first layer 98A adherent to the metal cap 102 may have a coefficient of thermal expansion of about $107\times10^{-7}$ in/in/degree C.; the separating ceramic layer 98C may have a coefficient of thermal expansion of about $105\times10^{-7}$ in/in/degree C., and the layer 98B adherent to the glass of the faceplate may have a coefficient of thermal expansion of about $103\times10^{-7}$ in/in/degree C.

Figure 7:
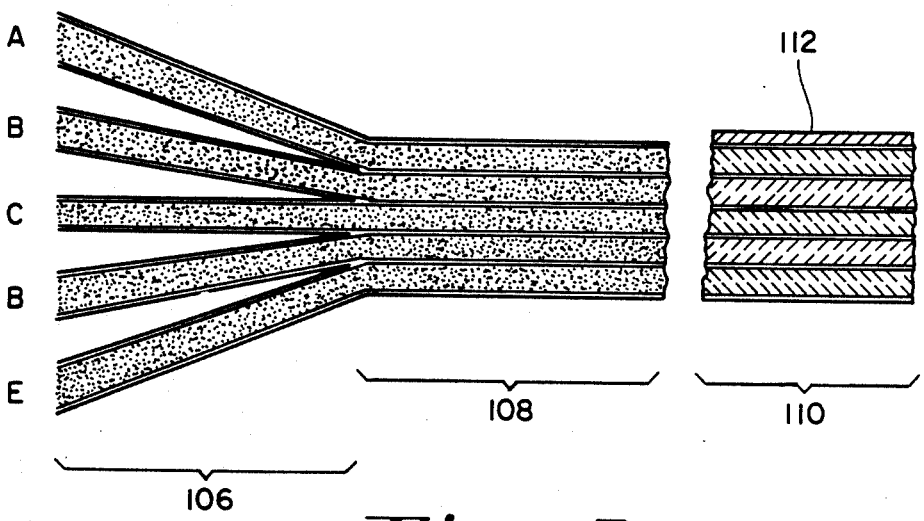
FIG. 7 is a diagrammatic view of extrusion means for manufacturing a multi-layer embodiment of a support structure according to the invention.

With reference now to FIG. 7, there is indicated the extrusion of five layers A–E of ceramic of different composition according to the invention, each with a different coefficient of thermal expansion; the extrusion head 106 is indicated diagrammatically. Following extrusion, the combined layers 108 are indicated as being ready for firing. Upon firing, the compositions are converted to five bonded layers, A–E, of hardened ceramic 110. A metal cap 112 provides for mounting a foil shadow mask in tension.

The metal caps in the two-layer configuration shown in detail by FIGS. 3–5, and three-layer configuration shown by FIG. 6 are preferably Alloy No. 27 manufactured by Carpenter Technology, Inc. of Reading, Pa. An advantage of the five-layer configuration depicted in FIG. 7 stems from the fact that a multiple layer configuration is more effective in absorbing the stresses produced between the extremities of the support structure. As a result, a less expensive cold-rolled steel cap 112 could as well be used for mounting the mask in lieu of the more costly Alloy No. 27.

The ceramic material may comprise, by way of example, a product known as "forsterite," designated generically as magnesium silicate. Ceramic is a refractory material that can be formed into layers according to the invention by the dry-pressing process, or preferably, by extrusion. It is essential that the precision and linearity of its dry-pressed or extruded configuration be maintained after firing, and that warping be at a minimum. Also, the composition of the the ceramic must be compatible chemically with that of the glass of the faceplate, and with the weldable metal cap or strip. Further, the ceramic must be of such composition that the internal environment of the tube will not be contaminated by the shedding of particulate matter, or by outgassing.

Since the layers A–E are formed in contact with each other, they can be made to bond to each other in the sintering process. If a more positive bond between the layers is desired, the discrete sintered layers, such as 98A, 98B and 98C in FIG. 6, are preferably adhered together by a lithium silicate glass, the introduction of which between the layers is indicated by arrows a and b in FIG. 6.

The composition of the lithium silicate in weight percent may be as follows

| | |
|---|---|
| $SiO_2$ | 71.7 |
| $Li_2O$ | 12.6 |
| $Al_2O_3$ | 5.1 |
| $K_2O$ | 4.9 |
| $B_2O_3$ | 3.2 |
| $P_2O_5$ | 2.5 |

As indicated by arrows a and b in FIG. 6, the lithium silicate can be applied between the layers to serve as the adherent medium. Upon heating of the combined layers 98 to temperatures approaching 1,800 degrees F., fusion results; that is, the combined layers become a cohesive mass by heating the lithium silicate to the melting temperature. The same adherent medium can be used in the two- and three-layer configurations depicted in FIGS. 3–5. Lithium silicate is in effect a "devitrifying" material in that once sintering takes place, the process is irreversible; that is, further heating to the same temperature will not cause it to re-liquify and cease to be an adherent. When sintering the rails together, the layers must be kept flat during sintering to prevent distortion because of the "biceramic" effect similar to the well-known deflection of a bimetallic strip. The lithium silicate preferably has a coefficient of thermal expansion of about $105\times10^{-7}$ in/in/degree C.

With regard to the two-layer ceramic support structure according to the invention, depicted in FIGS. 3 and 4, the composition of the two rails 48A-1 and 48A-2 in weight percent may be as follows, by way of example

| Rail 48A-1 | |
|---|---|
| Mistron vapor talc | 27.75 |
| Magnesium oxide | 36.74 |
| Nepheline syenite | 16.65 |
| Alumina | 5.55 |
| Zinc oxide | 11.09 |
| Calcium carbonate | 2.22 |

This composition is preferably fired at 2,500 degrees F. and held about one hour at peak temperature.

| Rail 48A-2 | |
|---|---|
| Yellowstone talc | 27.75 |
| Magnesium oxide | 36.74 |
| Custer feldspar | 16.65 |
| Alumina | 5.55 |
| Zinc oxide | 11.09 |
| Calcium carbonate | 2.22 |

This composition is preferably fired at 2,600 degrees F. and held for about one hour at peak temperature. The rails are preferably fired as a multilayer or monolith. Changes in coefficients of thermal expansion can be made by changes in the sintering as well as by changes in the composition. For example, coefficient of thermal expansion changes greater than 1 to $2\times10^{-7}$ in/in/degree C. can be made by varying the composition. The "fine tuning" of the coefficient of thermal expansion is accomplished by adjustments in the sintering cycle, the sintering temperature, and the time at peak temperature—adjustments that can be accomplished by those skilled in the art of ceramics manufacture without undue experimentation.

The ceramic shadow mask support structure must provide a coefficient of thermal expansion range of 100 to $110\times10^{-7}$ in/in/degree C. to satisfy the coefficients of thermal expansion of both the glass and the metal. A readily processed composition series providing high strength, low porosity and reasonable cost will contain magnesium oxide and zirconium oxide to provide a high coefficient of thermal expansion; silicon oxide and aluminum oxide provide the necessary strength, while potassium oxide and sodium oxide act as fluxes to promote sintering.

The cement described heretofore as being used for cementing the shadow mask support structures to the faceplate (e.g., beads of cement 83 in FIG. 4), and the metal strips and caps to the structures (e.g., beads of cement 86 in the same figure), preferably comprises the lithium silicate glass previously described. The cement may also comprise a devitrifying glass frit such as that supplied by Owens-Ilinois, Toledo, Ohio, under the designation CV-685. Alternately, the cement may comprise a cold-setting cement of the type supplied by Sauereisen Cements Company of Pittsburgh, Pa. The use of a devitrifying solder glass frit provides for the integral bonding of the ceramic of the mask support structure to the glass of the faceplate, as both are ceramics by classification, and hence capable of the intimate bonding defined as "welding"; that is, by intimately consolidating the components of the two ceramics. By its integral attachment to the glass, the ceramic mask-supporting structure according to the invention derives support from the glass, making the structure capable of withstanding the restorative forces inherent in the high tension of the foil shadow mask. The means of securement of the shadow mask metal to the metal can be by electrical spot welding, or preferably, laser welding.

When dry pressing is used for forming the mask support structure, only 2½ percent polyvinyl alcohol and ½ percent glycerine are required. Firing temperature is typically about 2550 degrees F. with a holding time of about two hours at temperature. To meet changing production requirements, ceramic compositions having a range of coefficients of thermal expansion from 103 to $109\times10^{-7}$ in/in/degree C. may be compounded and kept available in the production area.

With respect to dimensions (cited by way of example), the width of the weldable metal that receives and secures the shadow mask (e.g., caps 80A and 80B in FIG. 4) may be, according to the invention, a width in the range of 0.050 inch to a width equal to the width of the support structure; little structural advantage is gained if the width of the metal is greater than the width of the support structure. The thickness of the metal must be adequate for welding without loss of welding integrity; e.g., about 0.015 inch. The dimensions of the ceramic rails for use in a tube of 20-inch diagonal measure may be in the range of 0.350 to 0.385 inch high and 0.250 inch wide, also by way of example. The cross-sectional configuration may be rectangular, or there may be a slight inward (trapezoidal) taper near the mask-mounting surface. Opposed pairs of the four rails preferably have a length of about 12 inches and 15.9 inches, respectively. The the Q-distance is about 0.399 inch in the 20-inch diagonal tube; this height includes the thickness of the metal cap.

Typical dimensions in inches of the shadow mask support structures for a 14-inch diagonal measure tube are: Q-height 0.275 and width 0.225. The opposed pairs of the four rails preferably have a length in inches of about 8.2 and 10.9.

The elemental or oxide composition may comprise the following ranges in weight percent

| | |
|---|---|
| $Al_2O_3$ | 3 to 12.9 |
| $SiO_2$ | 26.6 to 52.8 |
| MgO | 28.6 to 63.1 |
| $K_2O$ | 0 to 4 |
| $Na_2O$ | 0 to 6 |
| CaO | 0 to 4 |
| BaO | 0 to 5 |
| ZnO | 0 to 27 |

The extrusion batch contains the ceramic composition, the organic binder/plasticizer system, and 15% to 35% water, depending on the extrusion conditions desired.

The ingredients are intimately and thoroughly mixed using ball-milling or other suitable techniques to ultimately provide a very high green (pre-fired) density. The careful mixing ensures a homogeneous condition on a micro-scale. When the extrusion process is used for forming the shadow mask supports, one or more binders/lubricants/plasticizers may be added to the dry ingredients to promote a smooth extrusion with minimum pressure. For example, 3 weight percent (of the ceramic composition) of the multifunctional additive Methocel A4M can be added to the list of ingredients described in the foregoing. In addition, 1 weight-percent of glycerine and 2 weight-percent of polyvinyl alcohol are added in the water solution to promote material flow and pre-fired strength in the mask support structure.

Methocel A4M is a cellulose ether available from Dow Chemical Co. of Midland, Mich.; polyvinyl alcohol is available from Air Products and Chemical Co., Inc. of Calvert, Ky.; and the glycerine and other chemicals can be had from Fisher Scientific Co. of Pittsburgh, Pa. Although specific suppliers and their designations are cited, equivalent materials of equivalent quality supplied by others may as well be used.)

When dry pressing is used for forming the mask support structure, only 2½ percent polyvinyl alcohol and ½ percent glycerine are required. Firing temperature is typically about 2550 degrees F. with a holding time of about two hours at temperature. To meet changing production requirements, ceramic compositions having a range of coefficients of thermal expansion from 103 to $109\times10^{-7}$ in/in/degree C. may be compounded and kept available in the production area.

By way of example (and with reference to the components shown by FIG. 4), the thermal coefficients of the components described may comprise

| | Parts per 10 million per degree Celsius |
|---|---|
| metal cap 80A; Alloy No. 27: | about 107 |
| two-layered ceramic support structure | |
| layer 48A-1 | about 107 |
| layer 48A-2 | about 104 |
| glass of faceplate: | about 103 |

Note:
Coefficients cited pertain to a temperature range of 25 degrees centigrade (ambient) to 435 degrees centigrade (the temperature at which glass frit devitrifies in the fritting cycle).

The preferred method of installing the mask is to stretch a pre-apertured shadow mask blank across the mask support structure by tensioning means. Suitable mask installation and tensioning means are fully described and claimed in referent copending application Ser. No. 831,696 of common ownership herewith. The mask is stretched across the supporting structure and is secured to the structure by electrical or laser welding. The weldments are preferably spaced about 0.040 inch around the circumference of the mask to ensure positive securement, so a mask for a 14-inch diagonal measure tube would have as many as 1,000 such weldments. Also, it is considered necessary that the weldable metal cap or strip have a flat surface to ensure positive, all-around intimate contact between the mask and the cap or strip. The flat surface may be created by means of a surface grinder, or by lapping; that is, by rubbing the surface of the supporting structure (when mounted on the faceplate) against a flat surface having an abrasive thereon.

While a particular embodiment of the invention has been shown and described, it will be readily apparent to those skilled in the art that changes and modifications may be made in the inventive means without departing from the invention in its broader aspects, and therefore, the aim of the appended claims is to cover all such changes and modifications as fall within the true spirit and scope of the invention.

We claim:

1. A faceplate assembly for a color cathode ray tube including a glass faceplate having on its inner surface a centrally disposed phosphor screen, and a foil shadow mask mounted in tension on a mask support structure located on opposed sides of the screen and secured to said inner surface, said mask support structure comprising at least two adhered layers of ceramic having different coefficients of thermal expansion.

2. A faceplate assembly for a color cathode ray tube including a glass faceplate having on its inner surface a centrally disposed phosphor screen, and a foil shadow mask mounted in tension on a mask support structure located on opposed sides of the screen and secured to said inner surface, said mask support structure having a metal cap for receiving and mounting said shadow mask in tension, and including at least two adhered layers of ceramic having different coefficients of thermal expansion effective to match the different coefficients of thermal expansion of the metal of said cap and the glass of said faceplate.

3. A faceplate assembly for a color cathode ray tube including a glass faceplate having on its inner surface a centrally disposed phosphor screen, and a foil shadow mask mounted in tension on a mask support structure comprising four discrete rails located on opposed sides of the screen and secured to said inner surface, said rails each having a metal cap for receiving and mounting said shadow mask, each of said rails including at least two adhered layers of ceramic having different coefficients of thermal expansion effective to match the different coefficients of thermal expansion of said metal cap and said glass of said faceplate.

4. A faceplate assembly for a color cathode ray tube including a glass faceplate having on its inner surface a centrally disposed phosphor screen, and a foil shadow mask mounted in tension on a generally rectangular, unitary mask support structure composed of ceramic and secured to said inner surface on opposed sides of the screen, said mask support structure having a metal cap for receiving and mounting said shadow mask in tension, and including at least two adhered layers of ceramic having different coefficients of thermal expansion effective to match the coefficients of expansion of said metal cap and said glass of said faceplate.

5. A faceplate assembly for a color cathode ray tube including a glass faceplate having on its inner surface a centrally disposed phosphor screen, and a foil shadow mask mounted in tension on a mask support structure located on opposed sides of the screen and secured to said inner surface, said mask support structure having a metal cap for receiving and mounting said shadow mask in tension, said structure comprising at least a first layer of ceramic nearest said cap and adhered thereto, and having a coefficient of thermal expansion compatible with the coefficient of thermal expansion of said metal of said cap, said structure further comprising a second layer of ceramic nearest said faceplate and adhered thereto and having a coefficient of thermal expansion compatible with the coefficient of thermal expansion of the glass of said faceplate, with the layering of said structure being effective to absorb the stresses produced due to the different expansion and contraction coefficients of the metal of said cap and the glass of said faceplate.

6. The faceplate assembly according to claim 5 wherein the coefficient of thermal expansion of said first layer is approximately equal to the coefficient of thermal expansion of said metal of said cap to yield a minimum stress condition, and the coefficient of thermal expansion of said second layer is higher than that of said glass to yield a minimum stress condition.

7. The faceplate assembly according to claim 6 wherein said coefficient of thermal expansion of said first layer is about $107\times10^{-7}$ in/in/degree C., and the coefficient of thermal expansion of said second layer is about $103\times10^{-7}$ in/in/degree C.

8. A faceplate assembly for a color cathode ray tube including a glass faceplate having on its inner surface a centrally disposed phosphor screen, and a foil shadow mask mounted in tension on a mask support structure located on opposed sides of the screen and secured to said inner surface, said mask support structure having a metal cap for receiving and mounting said shadow mask in tension, said structure comprising three layers of ceramic of different coefficients of thermal expansion adhered together and effective to match the different coefficients of expansion of said metal cap and said glass of said faceplate.

9. A faceplate assembly for a color cathode ray tube including a glass faceplate having on its inner surface a centrally disposed phosphor screen, and a foil shadow mask mounted in tension on a mask support structure located on opposed sides of the screen and secured to said inner surface, said mask support structure having a metal cap for receiving and mounting said shadow mask in tension, and comprising a sandwich consisting of a first layer of ceramic adherent to said cap and having a coefficient of thermal expansion compatible with the coefficient of thermal expansion of the metal of said cap, and a second layer of ceramic adherent to the glass of said faceplate and having a coefficient of thermal expansion compatible with the coefficient of thermal expansion of said glass, said first and second layer being spaced by a separating ceramic layer having a coefficient of thermal expansion intermediate to the coefficient of thermal expansions of said first and second layer, said layers and their different coefficients of thermal expansion being effective to absorb the stresses produced due to the differing expansion and contraction coefficients of said glass and said metal cap.

10. The faceplate assembly according to claim 9 wherein said first layer adherent to the metal of said cap has a coefficient of thermal expansion of about $107\times10^{-7}$ in/in/degree C., said second layer adherent to said glass has a coefficient of thermal expansion of about $103\times10^{-7}$ in/in/degree C., and where said separating ceramic layer has a coefficient of thermal expansion of about $105\times10^{-7}$ in/in/degree C.

* * * * *